US008430016B2

(12) United States Patent
Russell et al.

(10) Patent No.: US 8,430,016 B2
(45) Date of Patent: Apr. 30, 2013

(54) CONTROL VALVE ASSEMBLY WITH A WORKPORT PRESSURE REGULATING DEVICE

(75) Inventors: Lynn A. Russell, Eagle, WI (US); James E. Olsen, Oconomowoc, WI (US); Michael J. Clark, Hartland, WI (US)

(73) Assignee: HUSCO International, Inc., Waukesha, WI (US)

( * ) Notice: Subject to any disclaimer, the term of this patent is extended or adjusted under 35 U.S.C. 154(b) by 576 days.

(21) Appl. No.: 12/795,826

(22) Filed: Jun. 8, 2010

(65) Prior Publication Data

US 2010/0307606 A1 Dec. 9, 2010

Related U.S. Application Data

(60) Provisional application No. 61/185,244, filed on Jun. 9, 2009.

(51) Int. Cl.
*F15B 11/08* (2006.01)

(52) U.S. Cl.
USPC ..... 91/445; 91/447

(58) Field of Classification Search ..... 91/444–448
See application file for complete search history.

(56) References Cited

U.S. PATENT DOCUMENTS 4,693,272 A 9/1987 Wilke
5,333,450 A * 8/1994 Blendinger et al. ..... 60/459
5,579,642 A 12/1996 Wilke et al.
5,715,865 A 2/1998 Wilke
5,791,142 A 8/1998 Layne et al.
5,890,362 A 4/1999 Wilke
5,950,429 A 9/1999 Hamkins
6,098,403 A 8/2000 Wilke
6,318,079 B1 11/2001 Barber
6,745,992 B2 6/2004 Yang et al.
6,895,852 B2 5/2005 Pieper
6,901,754 B2 6/2005 Jervis
6,964,281 B2 11/2005 Pieper
7,089,733 B1 8/2006 Jackson et al.
7,222,484 B1 5/2007 Dornbach
7,373,869 B2 5/2008 Pfaff et al.
7,406,982 B2 8/2008 Pfaff et al.
7,415,989 B2 8/2008 Barber
7,484,814 B2 2/2009 Dornbach
7,487,707 B2 2/2009 Pfaff et al.

* cited by examiner

*Primary Examiner* — Edward Look
*Assistant Examiner* — Michael Quandt
(74) *Attorney, Agent, or Firm* — Quarles & Brady LLP; George E. Haas

(57) ABSTRACT

A hydraulic system has several valve sections, each having a directional valve that controls fluid flow from a pump to a hydraulic actuator. A mechanism senses a greatest pressure among the hydraulic actuators to provide a load sense pressure. One valve sections has a pressure compensation apparatus includes a pressure compensation valve that reduces fluid flow between a given directional valve and an associated hydraulic actuator in response to pressure at a control port, and a pressure regulating valve that responds to the load sense pressure and pressure in the associated hydraulic actuator by selectively applying output pressure from the pump and the load sense pressure to the control port.

20 Claims, 1 Drawing Sheet

CONTROL VALVE ASSEMBLY WITH A WORKPORT PRESSURE REGULATING DEVICE

CROSS-REFERENCE TO RELATED APPLICATIONS

This application claims benefit of U.S. Provisional Patent Application No. 61/185,244 filed on Jun. 9, 2009.

STATEMENT REGARDING FEDERALLY SPONSORED RESEARCH OR DEVELOPMENT

Not Applicable

BACKGROUND OF THE INVENTION

1. Field of the Invention

The present invention relates to hydraulic valves, and more particularly to devices that regulate pressure at the workports of such valves.

2. Description of the Related Art

Many types of machines have moveable members which are operated by an hydraulic actuator, such as a cylinder and piston arrangement or a hydraulic motor, that is controlled by a valve. The valve has one or two workports connected to the hydraulic actuator and selectively couples each workport to either an outlet of a pump or a fluid reservoir. For example, a three-position, four-way valve has two workports, one connected to the head chamber of a cylinder and piston arrangement and the other to the rod chamber. This valve is moved into different positions to apply pressurized fluid from the pump to first workport and drain fluid from the other workport into the reservoir. Which workport receives pressurized fluid and which workport is coupled to the reservoir determines the direction that the hydraulic actuator moves. Varying the amount that the valve opens controls the rate of fluid flow to and from the workport, thereby proportionally controlling the speed of the hydraulic actuator. The valve has a closed center position at which fluid is neither applied to or drained from the hydraulic actuator.

Damage to the machine and objects nearby can occur if the pressure at a workport exceeds a given level. Individual workport pressures can be limited in a post compensated, closed center valve by using a workport relief valve assembly. A common workport relief valve assembly maintains a spring biased, check valve element against a valve seat on the workport. When the workport pressure becomes greater than the pressure that the spring holding the check valve element closed can support, the workport relief valve opens thereby venting fluid to the reservoir. That venting reduces the pressure at the workport to the desired level.

Although this type of workport relief valve achieves the desired effect, it has an undesirable side affect. Even though the pressure is reduced to the desired level, a large portion of the pump output flow often is consumed by the workport relief valve venting it to the reservoir, which wastes available fluid flow and energy. Any other hydraulic functions being operated on the machine only can receive whatever amount of the pump output flow remains.

SUMMARY OF THE INVENTION

The present workport pressure regulating device serves to limit the pressure of the associated hydraulic function without the adverse consequences mentioned above. This device limits the associated hydraulic function by venting a considerably smaller flow to the reservoir. This preserves the majority of the pump output flow for other hydraulic functions and minimizes the energy that is wasted. In addition, the workport pressure regulating device reduces the pressure of the associated hydraulic function without affecting the pressure of other hydraulic functions. All other hydraulic functions are only limited by their own workport pressure regulating devices and the main system relief valve.

The hydraulic system has an array of valve sections for controlling flow of hydraulic fluid from a pump to a plurality of actuators. The pump produces an output pressure. Each valve section has a workport to which one of the plurality of actuators connects and has a directional valve that control flow of the hydraulic fluid from the pump to the workport. The array of valve sections being of a type in which a greatest pressure among the workports is sensed to provide a load sense pressure.

A pressure compensation apparatus comprises a pressure compensation valve that controls fluid flow between one directional valve and first workport in response to pressure at a control port; and a pressure regulating valve that responds to the load sense pressure and pressure in the first workport by selectively applying the output pressure from the pump and the load sense pressure to the control port.

In one embodiment of the pressure compensation apparatus, the pressure regulating valve comprises a shuttle. The shuttle has a first position in which the load sense pressure is applied to the control port, and a second position in which the output pressure from the pump is applied to the control port. The load sense pressure tends to move the shuttle toward the first position; and pressure in the first workport tends to move the shuttle toward the second position. A spring may be provided to bias the shuttle toward the first position.

DETAILED DESCRIPTION OF THE INVENTION

Figure 1:
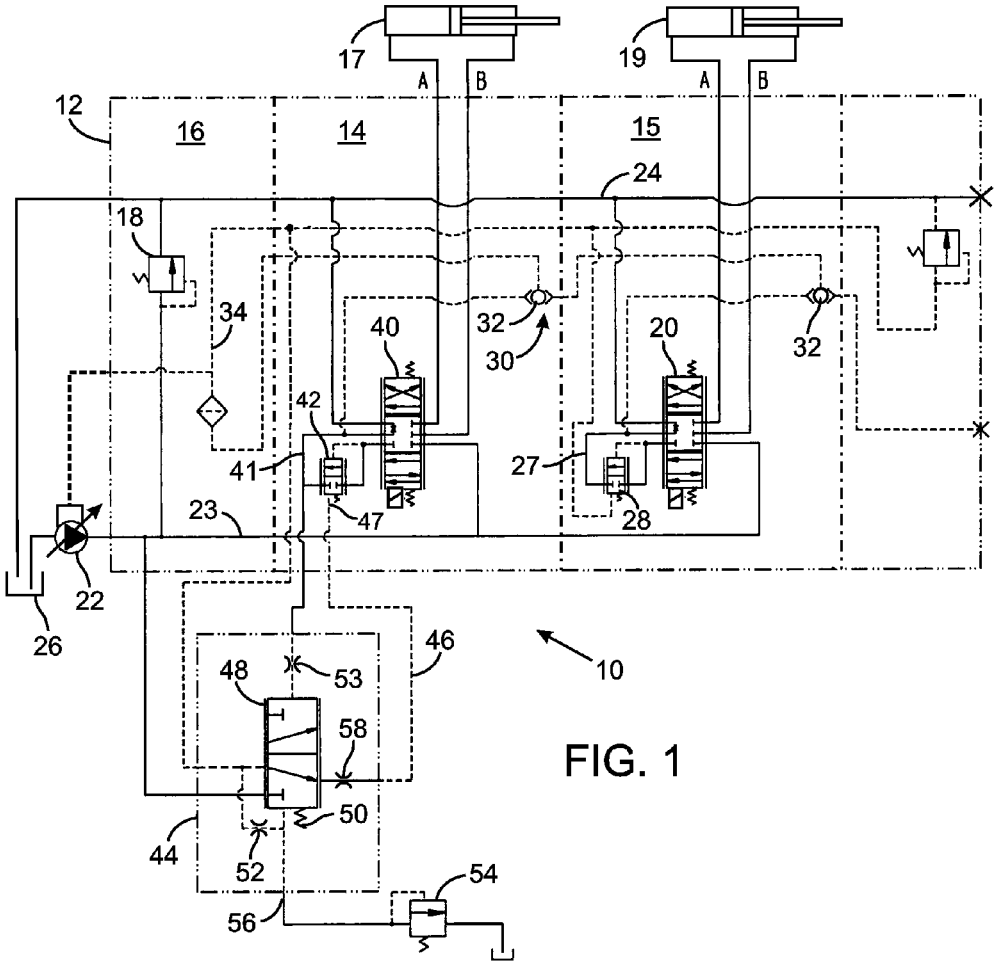
FIG. 1 is a schematic diagram of a hydraulic system incorporating a workport pressure regulating valve according to the present invention.

FIG. 1 schematically depicts a hydraulic system 10 that includes a multiple valve assembly 12 which has two individual valve sections 14 and 15 formed by separate metal bodies interconnected side-by-side with each section controlling a different hydraulic actuator on a machine. Each valve section 14 and 15 has two workports A and B that, for example, are connected to the rod and head chambers of a cylinder and piston type hydraulic actuator 17 and 19, respectively. An end section 16 of the valve assembly 12 contains ports for connecting a variable displacement pump 22 to a supply passage 23 and a fluid reservoir 26 to a tank passage 24. This end section 16 also includes a pressure relief valve 18 that releases excessive pressure in the supply passage 23 into the fluid reservoir 26. The valve assembly 12 has a conventional load sense system 30 that has a shuttle valve 32 in each valve section 14 and 15. Although cylinder and piston type hydraulic actuator are used as examples herein, the present invention may be used with other types of hydraulic actuators.

The second valve section 15 has a conventional design, similar to the valve sections described in U.S. Pat. No. 5,715,865, which description is incorporated herein by reference. That second valve section 15 has a standard three-position, four-way directional valve 20 with a spool that in different positions applies pressurized fluid from pump 22 to first workport A or B and drain fluid from the other workport into the tank passage 24 connected to the reservoir 26. When a directional valve 20 is shifted to an open position, the workport pressure is delivered to a bridge passage 27 in the valve. The load sense system 30 receives a pressure signal from the bridge passage 27.

The load sense system 30 selects the greatest workport pressure signal in all the valve sections and applies that greatest pressure via load sense line 34 to the control input of the variable displacement pump 22. The pump responds by producing an outlet pressure at a predetermined amount (the pump margin) greater than the load sense pressure. Since the pump 22 is always working to maintain a pressure greater than that in the load sense line 34, a controlled pressure drop is maintained across the directional valve 20.

The second valve section 15 has a pressure compensator valve 28 which opens in response to pump pressure from a metering orifice in the spool-type directional valve 20 being greater than the pressure in the load sense line 34. Otherwise, the pressure compensator valve 28 is biased closed by a spring. In the open state of the pressure compensator valve 28, the metered fluid flow travels back through the directional valve 20 to one of the workports A or B. The specific pressure differential across the pressure compensator valve 28 defines a pre-defined flow to the workport.

The first valve section 14 has a configuration similar to a three-position, four-way, spool-type directional valve 40 with a pressure compensator valve 42, except that the pressure compensator valve is not coupled directly to the load sense line 34, as in the second valve section 15. Instead, the pressure compensator valve 42 is coupled to a workport pressure regulating valve 44 according to the present invention.

As noted above, the specific pressure differential across the pressure compensator valve 42 establishes a pre-defined flow. The present concept involves controlling that pressure differential in order to manage the workport pressure. Because the pressure compensator valve 42 is spring biased into a closed state, the flow through the first valve section 14 can be stopped by applying pump pressure to both sides of the pressure compensator valve. The basic concept is to control the pressure at a workport by dithering between sending load sense pressure and pump pressure to the pressure compensator valve 42 through a return to compensator line 46 coupled to a control port 47 at the spring end of the pressure compensator valve 42. Thus the pressure compensation valve controls fluid flow between the directional valve 40 and a workport in the first section 14 in response to a differential in pressure between that workport and the control port 47.

Figure 2A:
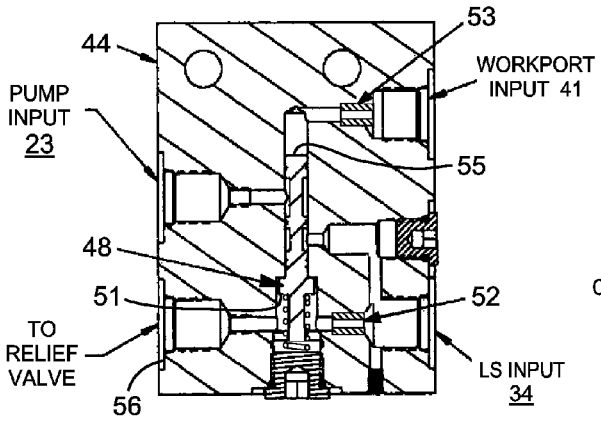
FIGS. 2A and 2B are orthogonal cross sectional views through the workport pressure regulating valve.
Figure 2B:
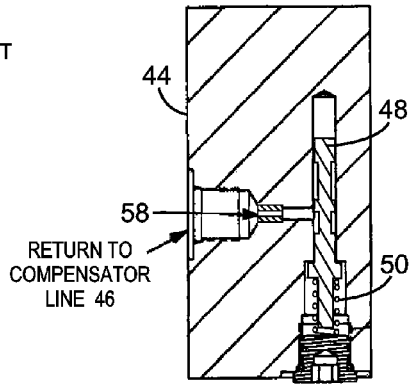

With additional reference to FIGS. 2A and 2B, a valve element formed by a shuttle 48 in the workport pressure regulating valve 44 is biased by spring 50 into a first position that is illustrated. In that first position, the load sense pressure in line 34 flows through an annular groove in the shuttle 48 and out into the return to compensator line 46. The load sense pressure also delivered through a first orifice 52 to the spring end of shuttle 48 where that pressure act on a first surface 51 of the shuttle. The pressure of the fluid at the first surface 51 is regulated by adjusting a relief valve 54 connected to an RV port 56. The workport pressure from the bridge 41 of the associated directional valve 40 is conveyed through a second orifice 53 to a second surface 55 at the opposite end (the non-spring end) of the shuttle 48.

When the relief valve 54 is adjusted to a pressure that is lower than that of the workport pressure in the bridge 41, the shuttle 48 is forced into a second position that compresses the spring 50. In this second position the shuttle provides a path through which the pump pressure is applied to the return to compensator line 46, thereby causing the pressure compensator valve 42 to begin to close and limit flow to the associated workport A or B. As flow to the workport reduces, the workport pressure decreases until falling below the pressure limit of the relief valve 54. When that occurs, the shuttle 48 moves in the direction of the force provided by the spring 50, which in turn delivers the load sense pressure via the return to compensator line 46 and a third orifice 58 to the pressure compensator valve 42. In this manner, the shuttle 48 dithers and maintains the pressure level as defined by the setting of the relief valve 54.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. In a hydraulic system having an array of valve sections for controlling flow of hydraulic fluid from a pump to a plurality of actuators, wherein the pump produces an output pressure, and in which each valve section has a workport to which one of the plurality of actuators connects and directional valve that control flow of the hydraulic fluid from the pump to the workport, the array of valve sections being of a type in which a greatest pressure among the workports is sensed to provide a load sense pressure; a pressure compensation apparatus comprising:

a pressure compensation valve that controls fluid flow between a first directional valve and a first workport in response to pressure at a control port; and a pressure regulating valve that responds to the load sense pressure and pressure in the first workport by selectively applying the output pressure from the pump and the load sense pressure to the control port.

2. The pressure compensation apparatus as recited in claim 1 wherein the pressure regulating valve comprises a shuttle having a first position in which the load sense pressure is applied to the control port and having a second position in which the output pressure from the pump is applied to the control port.

3. The pressure compensation apparatus as recited in claim 2 wherein the pressure regulating valve further comprises a spring that biases the shuttle toward the first position.

4. The pressure compensation apparatus as recited in claim 2 wherein the load sense pressure tends to move the shuttle toward the first position; and pressure in the first workport tends to move the shuttle toward the second position.

5. The pressure compensation apparatus as recited in claim 2 further comprising a pressure relief valve that prevents the load sense pressure acting on the shuttle from exceeding a predefined magnitude.

6. The pressure compensation apparatus as recited in claim 1 wherein the pressure regulating valve comprises:

a shuttle having a first surface and a second surface, wherein the load sense pressure acts on the first surface and tends to move the shuttle toward a first position that provides a path through which the load sense pressure is applied to the control port, and the pressure in the first workport acts on the second surface and tends to move the shuttle toward a second position that provides another path through which the output pressure from the pump is applied to the control port.

7. The pressure compensation apparatus as recited in claim 6 further comprising a pressure relief valve that prevents pressure acting on the first surface of the shuttle from exceeding a predefined magnitude.

8. The pressure compensation apparatus as recited in claim 6 further comprising a first orifice providing a path through which the load sense pressure is applied to the first surface of the shuttle; and a second orifice providing another path through which the pressure in the first workport is applied to the second surface of the shuttle.

9. The pressure compensation apparatus as recited in claim 8 further comprising a third orifice through which pressure is conveyed from the pressure regulating valve to the control port of the pressure compensation valve.

10. The pressure compensation apparatus as recited in claim 1 wherein the pressure compensation valve controls fluid flow between a first directional valve and a first workport in response to a pressure difference between a pressure derived from the output pressure and a pressure at the control port.

11. In a hydraulic system wherein fluid, at a supply pressure in a supply line, is conveyed though an array of valve sections to a plurality of actuators, wherein each valve section has a workport to which one of the plurality of actuators connects and has a directional valve that controls flow of the fluid to that one actuator, the array of valve sections being of a type in which a greatest pressure among the workports is sensed to provide a load sense pressure; a pressure compensation apparatus in a first valve section and comprising:

a pressure compensation valve that reduces fluid flow between a first directional valve and a first workport in response to pressure at a control port; and a pressure regulating valve that applies the load sense pressure to the control port when the load sense pressure is greater than pressure in the workport, and that applies the supply pressure to the control port when the load sense pressure is less than pressure in the workport.

12. The pressure compensation apparatus as recited in claim 11 wherein the pressure regulating valve comprises a shuttle having a first position in which the load sense pressure is applied to the control port and having a second position in which the supply pressure is applied to the control port.

13. The pressure compensation apparatus as recited in claim 12 wherein the pressure regulating valve further comprises a spring biasing the shuttle toward the first position.

14. The pressure compensation apparatus as recited in claim 12 wherein the load sense pressure tends to move the shuttle toward the first position; and pressure in the first workport tends to move the shuttle toward the second position.

15. The pressure compensation apparatus as recited in claim 11 further comprising a pressure relief valve that prevents the load sense pressure acting on pressure regulating valve from exceeding a predefined magnitude.

16. The pressure compensation apparatus as recited in claim 11 wherein the pressure regulating valve comprises:

a shuttle having a first surface and a second surface, wherein the load sense pressure acts on the first surface and tends to move the shuttle toward a first position in which the load sense pressure is applied to the control port, and the pressure in the first workport acts on the second surface and tends to move the shuttle toward a second position in which the supply pressure is applied to the control port.

17. The pressure compensation apparatus as recited in claim 16 further comprising a pressure relief valve that prevents pressure acting on the first surface of the shuttle from exceeding a predefined magnitude.

18. The pressure compensation apparatus as recited in claim 16 further comprising a first orifice providing a path through which the load sense pressure is applied to the first surface of the shuttle; and a second orifice providing another path through which the pressure in the first workport is applied to the second surface of the shuttle.

19. The pressure compensation apparatus as recited in claim 18 further comprising a third orifice through which pressure is conveyed from the pressure compensation valve to the control port of the pressure compensation valve.

20. The pressure compensation apparatus as recited in claim 11 wherein the pressure compensation valve controls fluid flow between a first directional valve and a first workport in response to a pressure difference between a pressure derived from the supply pressure and a pressure at the control port.

* * * * *